United States Patent [19]

Shimada et al.

[11] Patent Number: 4,744,797

[45] Date of Patent: May 17, 1988

[54] MIXED FUEL OF COAL POWDER OR THE LIKE AND HEAVY OIL

[76] Inventors: Yoshinari Shimada, 6-40, Asashigaoka 4-chome, Asaka-shi, Saitama 351; Tasuku Sugita, 22-3, Honkomagome 2 Bunkyo-ku, Tokyo 112, both of Japan

[21] Appl. No.: 104,548

[22] Filed: Sep. 30, 1987

Related U.S. Application Data

[63] Continuation of Ser. No. 821,732, filed as PCT JP85/00221, Apr. 21, 1984 published as WO85/04895, Nov. 7, 1985, abandoned.

[30] Foreign Application Priority Data

Apr. 21, 1984 [JP] Japan ..... 59-79361

[51] Int. Cl.[4] ..... C10L 1/32

[52] U.S. Cl. ..... 44/51

[58] Field of Search ..... 44/51

[56] References Cited

U.S. PATENT DOCUMENTS

| | | | |
|---|---|---|---|
| 4,082,516 | 4/1978 | Metzger | 44/51 |
| 4,187,078 | 2/1980 | Shimizu et al. | 44/51 |
| 4,203,729 | 5/1980 | Ishizaki et al. | 44/51 |
| 4,251,230 | 2/1981 | Sawyer et al. | 44/51 |
| 4,436,527 | 3/1984 | Yamamura et al. | 44/51 |
| 4,492,590 | 1/1985 | Schick et al. | 44/51 |

FOREIGN PATENT DOCUMENTS

| | | | |
|---|---|---|---|
| 1175653 | 10/1984 | Canada | 44/51 |
| 59-0149993 | 2/1983 | Japan | 44/51 |
| 58-0093791 | 6/1983 | Japan | 44/51 |
| 59-0149991 | 8/1984 | Japan | 44/51 |
| 59-0149992 | 8/1984 | Japan | 44/51 |

*Primary Examiner*—William R. Dixon, Jr.
*Assistant Examiner*—Margaret B. Medley
*Attorney, Agent, or Firm*—Armstrong, Nikaido, Marmelstein & Kubovcik

[57] ABSTRACT

This invention relates to a mixed fuel comprising a coal powder or the like and heavy oil obtained by adding and mixing a dilute aqueous solution of a water-soluble high-molecular compound and a carbonaceous solid fuel powder such as coal powder or the like (hereinafter referred to as "coal powder and the like") to heavy oil so as to disperse the coal powder and the like and water (in very fine particle state) in heavy oil and being suitable as fuel for boilers, various furnaces, internal combustion engines, and the like.

2 Claims, No Drawings

MIXED FUEL OF COAL POWDER OR THE LIKE AND HEAVY OIL

This application is a continuation of application Ser. No. 821,732 filed as PCT JP85/00221 on Apr. 21, 1984, published as WO85/04895 Nov. 7, 1985, abandoned.

DESCRIPTION

1. Title of the Invention

DETAILED EXPLANATION OF THE INVENTION

This invention relates to a stabilized mixed fuel comprising a coal powder or the like and heavy oil obtained by dispersing a carbonaceous solid fuel powder such as coal powder or the like and water in heavy oil which is suitable as fuel for boilers, various furnaces and internal combustion engines.

Mixed fuel obtained by mixing a carbonaceous solid fuel powder such as coal powder, petroleum coke powder or the like with heavy oil has advantages in that there is no fear of explosion due to dust such as coal powder, or the like, a coal powder or the like can be handled like a liquid fuel, consumption of heavy oil can be reduced, a large amount of coal powder or the like can be burnt using heavy oil as an auxiliary fuel, so that the study of it is particularly regarded as important since the oil crisis. The mixed fuel obtained by mixing coal powder or the like in heavy oil has a higher viscosity than heavy oil, so that when it is burnt with raising the temperature with heating like the heavy oil, there is a tendency to cause sedimantation and separation even if the coal powder is subjected to considerable atomization since the specific gravity of coal powder or the like is by far larger than that of heavy oil. When the sedimentation takes place, there is a fear of clogging pipes, valves, burner nozzles and the like, so that a surface active agent or the like is added to the heavy oil in or to improve the dispersion.

Further, the dispersion of water in the mixed fuel is also studied. This is because the presence of water has effects in that the mixed fuel is atomized at the time of combustion to increase combustion efficiency, the content of nitrogen oxides and carbon monoxide in combustion exhaust gases is lowered, and the like. For the dispersion of water, a surface active agent is also used. The use of the surface active agent makes emulsification and dispersion easy, but has a tendency to separate the water, coal powder, and the like partly when the mixed fuel is heated and stored at the heated state, and has a defect of causing troubles at the time of combustion.

This invention provides a mixed fuel comprising a coal powder or the like and heavy oil, obtained by dispersing a carbonaceous solid fuel powder such as coal powder or the like and water in heavy oil, and being good in dispersion of the coal powder or the like, emulsified dispersion of the water and combustion efficiency.

Further, this invention relates to a mixed fuel comprising a coal powder or the like and heavy oil characterized by dispersing a carbonaceous solid fuel powder such as coal powder or the like and a dilute aqueous solution of a water-soluble high-molecular weight compound in heavy oil.

The heavy oil in this invention includes A heavy oil, B heavy oil, C heavy oil, a mixed heavy oil obtained by optionally mixing these heavy oils, a mixture obtained by mixing these heavy oils with gas oil or the like fuel oil, a mixture obtained by mixing these heavy oils with heavy still residue oil (for example, asphalt), and the like. It is also possible to use heavy crude oil, and still residue fuel oil which is a residue obtained by distilling light portions from crude oil.

The carbonaceous solid fuel powder such as coal powder or the like includes powders of coal such as lignite, brown coal, bituminous coal, smokeless coal, and the like, coke powder, petroleum coke powder, and the like. It is also possible to use charcoal, active carbon powder, and the like. These coal powder and the like carbonaceous solid fuel powders (hereinafter referred to as "coal powder and the like") are preferably in the state of very fine particles, almost all of which can pass a sieve of 200 mesh, preferably can pass a sieve of 300 mesh. When the particle size is large, not only sedimentation takes place but also ignitability and combustibility of the coal powder and the like are lowered.

The water-soluble high-molecular weight compound used in this invention includes gelatin, glue, an alkali salt of casein, albumin, hemoglobin, polyvinyl alcohol, an alkali salt of alginic acid, methylcellulose, hydroxyethylcellulose, hydroxypropylcellulose, sodium carboxymethylcellulose (CMC), polyvinyl pyrrolidine, polyacrylic acid and a salt thereof, polyacrylamide, polyethyleneimine, polyethylene glycol, starch, cation starch, dextrin, gum arabic, and the like. These can be used alone or as a mixture of two or more of them. Further, it is possible to use a sulfonate of naphthaleneformaldehyde condensate, a sulfonate of an aromatic polycyclic condensate, a triazine series dispersant, a lignin series dispersant, and the like.

Among the water-soluble high-molecular compounds, gelatin and glue are preferable because of the use in small amounts and excellent dispersing effect.

The concentration of the water-soluble high-molecular weight compound in a dilute aqueous solution thereof is about 1 to 0.0001% by weight, preferably about 0.5 to 0.001% by weight, but is different depending on the kinds of water-soluble high-molecular compounds. For example, in the case of gelatin and glue, the amount of about 0.1 to 0.001% by weight is sufficient in practical use. Further, the concentration is different depending on the amount of coal powder and the like to be dispersed. In general, as the amount of coal powder and the like to be dispersed increases, the using amount of it increases slightly accordingly. The dilute aqueous solution of water-soluble high-molecular weight compound (hereinafter referred to "water component") is an aqueous solution obtained by dissolving the water-soluble high-molecular weight compound in water in the above-mentioned proportion, and can be added with an antiseptic, a bactericide, or the like. Further, it is also possible to disperse therein small amounts of a surface active agent, a dispersant, a water-soluble salt, an acid, an alkali, and fine particles of solid substances such as lamp soot, soot, carbon black, and the like.

Moreover, it is also possible to use as the dilute aqueous solution of water-soluble high-molecular compound a black writing liquid, for example, obtained by dispersing lamp soot, soot or the like in water in the presence of glue.

The proportion of the water component for the heavy oil changes depending on the mixing ratio of the coal powder and the like, but generally is 70 to 99% by volume of heavy oil and 1 to 30% by volume of water component, preferably 75% by volume or more of heavy oil and 25% by volume or less of water component, considering ignitability and combustibility of the coal powder and the like in the mixed fuel for practical use. But the water component can easily be dispersed in heavy oil in about equal volume, when combustibility is not considered.

The mixing ratio of the coal powder and the like and the heavy oil is in general 70 to 30% by weight of the coal powder and the like and 30 to 70% by weight of the heavy oil.

The temperature of heavy oil at the time of dispersing the coal powder and the like and the water component in the heavy oil is not particularly limited.

Usually, the temperature range of 30° to 60° C. is suitable for the heavy oil, but lower temperatures and higher temperatures than that temperature can be employed.

The temperature of the water component is room temperature but may be raised. In general, even if not heated, good emulsification can be attained.

As to the temperature of the coal powder and the like, room temperature is used, but it may be raised with heating.

In order to disperse and emulsify the coal powder and the like and the water component in heavy oil, it is sufficient to mix with stirring them using a conventional stirring apparatus. For example, heavy oil, the coal powder and the like and the water component are placed in a stirring and mixing tank equipped with a suitable stirring device and mixed with stirring.

As the stirring and mixing apparatus, there can be used various types. For example, there can be used various stirring and mixing devices such as blade type, paddle type, propeller type, helical axis type, helical ribbon type, and the like. Usually, the stirring rate may be 200 revolutions or less per minute. It is usual to mix with stirring under low shear force of almost about 50 to 150 revolutions/min. The mixing is continued until the coal powder and the like and the water component are dispersed in the state of very fine particles in the heavy oil component, but such a time can generally be attained in several minutes. Mixing with stirring at low revolution rate can give a mixed fuel with a tendency of introducing a lesser amount of bubbles and with good dispersibility. When the revolution is fast, bubbles are introduced into the mixed fuel and hardly removed, which results in causing lowering in combustion efficiency at the time of combustion. Further, in order to prevent the introduction of bubbles, it is possible to add a small amount of an anti-foaming agent.

Further, it is possible to use an emulsifying machine such as a homomixer, a homogenizer, a colloid mill, or the like. But, when bubbles are included in the resulting mixed fuel oil, it is necessary to remove them in a long time, or under reduced pressure, or using other suitable method.

In order to disperse the coal powder and the like and water with the heavy oil mentioned above, either one of them may be added first or all of them may be added at the same time. For example, it is possible to use a method wherein a water-in-oil emulsion is produced by adding the water component to heavy oil, followed by mixing with the coal powder and the like, a method wherein the coal powder and the like are added and mixed with heavy oil, followed by mixing with the water component, a method of mixing a mixture of the coal powder and the like and water with heavy oil, or a method wherein heavy oil and a mixture of the coal powder and the like and the water component are mixed at the same time. Further, a water-soluble high-molecular compound or an aqueous solution thereof may be added to a mixture of the coal powder and the like and water, followed by mixing with heavy oil.

The particle size of the water component dispersed in heavy oil is 100 μm or less in diameter. In the case of burning in boilers and various furnaces, it is preferable to make the particle of water component not too fine, and the particle size of about 5 to 30 μm is suitable for micro-explosion of oil drops jetted from a burner nozzle at the time of combustion. In the case of using in an internal combustion engine, it is advantageous to disperse the water component in finer microparticles than the case mentioned above. In the former case, the mixing with stirring by low shear force is better than the emulsification by an emulsifying machine, and in the latter case, the emulsification by an emulsifying machine is suitable.

In order to improve the dispersion of the coal powder and the like in heavy oil, it is possible to co-use conventionally used known methods. For example, it is possible to improve the dispersion of the coal powder and the like in heavy oil by previously dissolving in the heavy oil a small amount (for example 0.1 to 0.5% by weight) of an additive such as an amine series surface active agent (e.g., tallow diamine, oleylpropylendiamine, etc.), a higher fatty acid salt thereof, a higher fatty acid, a metal soap (e.g., zinc naphthenate, magnesium naphthenate, etc.), lecithin, fatty acid amide, or the like. In the mixed fuel of this invention, the emulsification and dispersion of the water component in the heavy oil is good and the co-use of these additives is possible so long as they do not prevent the functional effect of the water-soluble high-molecular compound for assisting the emulsification and dispersion. Further, by using a small amount of these additives together, it is possible to produce a more stable mixed fuel.

Next, characteristics and effects of the mixed fuel of this invention are explained in summary.

(1) The mixed fuel is obtained by dispersing coal powder and the like carbonaceous solid fuel powder in a water-in-oil emulsion of heavy oil, and only a small amount of a water-soluble high-molecular weight compound is used for dispersing the coal powder and the like and water in the heavy oil. The presence of the water-soluble high-molecular weight compound makes the dispersion and emulsification of water in the heavy oil easy, and even if the mixed fuel is stored at a relatively high temperature, no separation and liberation of water take place, the dispersion of water particles is stable, sedimentation and separation of the coal powder and the like are slight, and thus the mixed fuel is stable.

(2) The proportions of the heavy oil and the coal powder and the like of the mixed fuel are about 30 to 70% by weight of the heavy oil and 70 to 30% by weight of the coal powder and the like. The coal powder and the like can be mixed in a higher proportion than that mentioned above, but the resulting mixed fuel becomes difficult to use due to an enhanced viscosity. The amount of water in the mixed fuel in relation to those of heavy oil and water, is 70 to 99% by volume of heavy oil and 1 to 30% by volume of water, preferably 75% by volume or more of heavy oil and 1 to 25% by volume or less of water. The particle size of the coal powder and the like is that passing a sieve of 200 mesh in most cases, and preferably that passing a sieve of 300 mesh. Thus, there can be obtained the mixed fuel which is not poor in ignitability, combustibility and the like, practically good in combustion efficiency, good in combustibility and clean as to combustion exhaust gases.

(3) When the mixed fuel is burnt by a burner, the color of flame of the burner is white, that is complete combustion without giving smoke can be attained.

(4) The exhaust gases from the combustion of the mixed fuel are cleaner with colorless smoke than those of heavy oil, coal powder and the like, or a mixture thereof, and the contents of $NO_x$, CO and the like are low.

(5) Reasons for the fact that the mixed fuel is stable for a long period of time when maintained at a relatively higher temperature seem to be as follows.

The water-soluble high-molecular weight compound dissolved in water seems to have functions of not only emulsifying and dispersing the water in the heavy oil but also holding the water in a very fine water drop emulsified and dispersed to stabilize the water drop, and orienting the coal powder and the like particles dispersed in the heavy oil at the interface of the water drop to contact with the water drop and to take a stable dispersing state.

(6) Further, since the mixed fuel supplied from a burner nozzle at the time of combustion in the form of droplets is further atomized by micro-explosion due to rapid vaporization of water drop in the droplets and burnt, the combustibility is good. Further, since the presence of water vapor can conduct complete combustion mildly without necessitating an extremely excess amount of air at the time of combustion due to its catalytic activity, the combustion temperature becomes lower than that of heavy oil and the contents of $NO_x$, $SO_x$, CO and the like in exhaust gases are remarkably lowered. In addition, the temperature of exhaust gases is lowered to lessen heat loss. Further, since the combustion temperature becomes lower, degradation of boilers, combustion furnaces, internal combustion engines and the like due to heating at high temperatures is lightened, which results in increasing the durability of these apparatuses.

The mixed fuel of this invention is explained by way of Examples.

EXAMPLE 1

A 2% aqueous solution of glue is prepared by dissolving 2 parts by weight of glue in 98 parts by weight of city water. The aqueous solution is further diluted with city water to give a 0.02% aqueous solution, which is used as a water component.

Bituminous coal (specific gravity 1.5) is pulverized by an attritor and passed through a 200 mesh sieve to give a coal powder. About 70% of the coal powder passes through a 300 mesh sieve.

In a cylinder type stirring and mixing tank equipped with a propeller type stirrer, C heavy oil at about 40° C. and the water component at about 25° C. are placed in proportions shown in Table 1 and mixed for about 5 minutes, followed by mixing with the coal powder for about 5 minutes to give a mixed fuel. The number of revolution of the stirrer is 140 to 150 r.p.m.

| | 1 | 2 | 3 | 4 | 5 |
|---|---|---|---|---|---|
| C heavy oil (parts by wt.) | 100 | 100 | 100 | 100 | 100 |
| Water component (parts by wt.) | 5 | 5 | 5 | 10 | 10 |
| Coal powder (parts by wt.) | 43 | 100 | 233 | 43 | 100 |
| C heavy oil/coal powder ratio in the mixed fuel | 70/30 | 50/50 | 30/70 | 70/30 | 50/50 |

-continued

| | 6 | 7 | 8 | 9 | 10 |
|---|---|---|---|---|---|
| C heavy oil (parts by wt.) | 100 | 100 | 100 | 100 | 100 |
| Water component (parts by wt.) | 10 | 30 | 30 | 30 | 60 |
| Coal powder (parts by wt.) | 233 | 43 | 100 | 233 | 43 |
| C heavy oil/coal powder ratio in the mixed fuel | 30/70 | 70/30 | 50/50 | 30/70 | 70/30 |

| | 11 | 12 | 13 | 14 | 15 |
|---|---|---|---|---|---|
| C heavy oil (parts by wt.) | 100 | 100 | 100 | 100 | 100 |
| Water component (parts by wt.) | 60 | 60 | 90 | 90 | 90 |
| Coal powder (parts by wt.) | 100 | 233 | 43 | 100 | 233 |
| C heavy oil/coal powder ratio in the mixed fuel | 50/50 | 30/70 | 70/30 | 50/50 | 30/70 |

These mixed fuels are placed in test tubes individually and allowed to stand at 50±2°C. in a constant temperature bath. After 1 week, 2 weeks, 3 weeks and 4 weeks, individual samples are taken out from the upper portions of mixed fuels in about 2 to 3 cm from the top to examine emulsification and dispersion states of water particles, separation of water, the presence or absence of liberation, dispersion of coal powder, sedimentation and the like by using a microscope.

The dispersion states of water and coal powder are good in all the cases.

Mixed fuels of Nos. 2, 5, 8, 9, 11 and 14 are burnt by a heavy oil burner, but those of Nos. 11 and 14 are lowered in ignitability and combustibility compared with the rest of the mixed fuels and show a tendency not to burn coal powders completely.

EXAMPLE 2

A 2% gelatin aqueous solution is prepared by dissolving 2 parts by weight of gelatin in 98 parts by weight of city water. This aqueous solution is diluted with city water to give a 0.01% aqueous solution which is used as a water component.

Petroleum coke (specific gravity 1.38) is pulverized by an attritor and passed through a 300 mesh sieve to give a petroleum coke powder.

Using the same stirring and mixing tank as used in Example 1, 20 parts by weight of the water component is added to 100 parts by weight of B heavy oil and mixed for 5 minutes, followed by addition and mixing of 100 parts by weight of the petroleum coke powder for 5 minutes to give a mixed fuel good in dispersion of the petroleum coke and water and good in storage stability.

EXAMPLE 3

The water component used in Example 2 in an amount of 10 parts by weight and 90 parts by weight of C heavy oil are mixed for 5 minutes by using a homomixer, followed by addition and mixing of 100 parts by weight of the petroleum coke powder used in Example 2 for 5 minutes to give a mixed fuel good in dispersion of the petroleum coke and water and good in storage stability.

EXAMPLE 4

To 100 parts by weight of B heavy oil at about 30° C., 20 parts by weight of a 0.05% aqueous solution of polyvinyl alcohol at about 25° C. is added and stirred at a revolution rate of 120 r.p.m. by using a propeller type stirrer for 6 minutes, followed by addition and mixing of 100 parts by weight of the coal powder used in Example 1 for 5 minutes to give a mixed fuel good in dispersion of the coal powder and water and good in storage stability.

Using the mixed fuels of Nos. 5 and 8 of Example 1, Example 2 and Example 3, combustion tests were conducted for 2 hours by a boiler. The combustion was complete without producing black smoke in exhaust gases and the color of burning burner was white with good combustion in all the cases.

We claim:

1. A mixed fuel consisting essentially of a carbonaceous solid fuel powder and a heavy oil, wherein the mixed fuel is obtained by dispersing a carbonaceous sold fuel powder and a dilute aqueous solution of at least one compound selected from the group consisting of gelatin and glue in a heavy oil, and wherein (a) the proportions of said heavy fuel and said carbonaceous solid fuel powder are 70 to 30% by weight of heavy oil and 30 and 70% by weight of carbonaceous sold fuel powder, (b) the proportions of said heavy oil and said dilute aqueous solution of a compound selected from the group consisting of a gelatin and glue are 75 to 99% by volume of heavy oil and 35 to 1% by volume of the aqueous solution, (c) the dilute aqueous solution of a compound selected from the group consisting of gelatin and glue is an aqueous solution of 1 to 0.0001% by weight of a compound selected from the group consisting of gelatin and glue, and (d) the particle size of the water component in the aqueous solution is about 5 to 30 um.

2. The mixed fuel according to claim 1, wherein the carbonaceous solid fuel powder is coal.

* * * * *